US005158266A

United States Patent [19]

Alten

[11] Patent Number: 5,158,266

[45] Date of Patent: Oct. 27, 1992

[54] VEHICLE LIFT

[75] Inventor: Ferdinand Alten, Mandern, Fed. Rep. of Germany

[73] Assignee: August Bilstein GmbH & Co. KG, Ennepetal, Fed. Rep. of Germany

[21] Appl. No.: 821,281

[22] PCT Filed: Feb. 14, 1990

[86] PCT No.: PCT/DE90/00094

§ 371 Date: Dec. 7, 1990

§ 102(e) Date: Dec. 7, 1990

[87] PCT Pub. No.: WO90/10594

PCT Pub. Date: Sep. 20, 1990

Related U.S. Application Data

[63] Continuation of Ser. No. 602,286, Dec. 7, 1990, abandoned.

[30] Foreign Application Priority Data

Mar. 8, 1989 [DE] Fed. Rep. of Germany ... 8902808[U]

[51] Int. Cl.[5] ..... B66F 3/00

[52] U.S. Cl. ..... 254/126; 254/DIG. 4

[58] Field of Search ..... 254/122, 124, 126, DIG. 4; 16/114 R

[56] References Cited

U.S. PATENT DOCUMENTS

| | | | |
|---|---|---|---|
| 2,560,797 | 7/1951 | Humphreys | 254/126 |
| 2,587,067 | 2/1952 | Sachtleber | 254/126 |
| 2,758,816 | 8/1956 | Pickard et al. | 254/126 |
| 3,857,548 | 12/1974 | Takeuchi | 254/126 |
| 4,583,713 | 4/1986 | Fukura et al. | 254/126 |
| 4,765,595 | 8/1988 | Alten | 254/122 |

*Primary Examiner*—J. J. Swann

*Attorney, Agent, or Firm*—Max Fogiel

[57] ABSTRACT

A jack with a single leg, with a lifting arm that pivots around a stationary horizontal axis on the leg, with a threaded shaft that is articulated to the leg and engages the lifting arm either directly or by way of lever arms articulated to the leg, and with a manually operated crank that has non-rotationally secured to its end a claw that has a transverse slot and sides that can be employed to attach the claw to a transverse bolt on the end of the shaft loosely enough to allow the crank to activate the shaft even when it is not aligned with it. The transverse slot (17) in the claw (18) slides over the transverse bolt (20) and, at the end of the side of the claw, has a width (X) no greater than the diameter (21) of the bolt, in that the claw fits loosely enough around the bolt to allow it to rotate, and in that the sides (19) of the claw have prongs (22) that loosely surround the threaded shaft.

8 Claims, 1 Drawing Sheet

VEHICLE LIFT

The present application is a continuation of the parent application Ser. No. 602,286 filed Dec. 7, 1990, now abandoned.

BACKGROUND OF THE INVENTION

The invention concerns a jack with a single leg, with a lifting arm that pivots around a stationary horizontal axis on the leg, with a threaded shaft that is articulated to the leg and engages the lifting arm either directly or by way of lever arms articulated to the leg, and with a manually operated crank that has non-rotationally secured to its end a claw that has a transverse slot and sides that can be employed to attach the claw to a transverse bolt on the end of the shaft loosely enough to allow the crank to activate the shaft even when it is not aligned with it.

Providing a jack, especially a scissoring jack or a two-point articulation jack of the scissoring type, with a detachable crank to overcome the unavoidable distance between the jack and its user is generally known. Using a slip-over polygon to attach such a crank is also generally known. Alternatively, providing the shaft of such a jack with an eye and the crank with a hook that hooks into the eye and entrains the shaft when the crank is rotated is known.

A jack with the aforesaid characteristics is known from German GM 8 701 736. The claw has an open slot that is longitudinal and hence parallel to the shaft of the crank. The slot fits over one end of a transverse bolt. The other side of the claw has another slot that slides over the bolt. The slots in the two sides fit loosely enough over the bolt to allow use of the crank even when its shaft is not aligned with the threaded shaft. The crank will accordingly not separate unintendedly from the jack. It has, however, been discovered that this mode of attachment is not evident or at least not obvious to an uninstructed user.

SUMMARY OF THE INVENTION

The object of the present invention is accordingly to improve a jack of the aforesaid type to the extent that even an uninstructed user will fully comprehend how to attach the crank to the threaded shaft such that they will not unintendedly separate to the greatest extent possible.

This object is attained in that the transverse slot in the claw slides over the transverse bolt and, at the end of the side of the claw, has a width no greater than the diameter of the bolt, that the claw fits loosely enough around the bolt to allow it to rotate, and in that the sides of the claw have prongs that loosely surround the threaded shaft.

It is significant to the invention that the transverse slot demarcated by the two sides of the claw is exploited for attaching the crank to the threaded shaft with the claw. The attachment is established just by fitting the two parts together and, since it constitutes the only possibility of obtaining a rotating connection between the crank and the jack, even an uninstructed user cannot be misled. It is also of significance that the transverse slot is no wider than the transverse bolt is thick. Due to the comparatively more extensive distance between the sides of the claw behind the slot in conjunction with the dimensions of the transverse slot, any rotation of the crank in relation to the threaded shaft will prevent the two parts from separating. It is, finally, also of significance that the sides of the claw surround the threaded shaft loosely, so that, when the crank tilts out of alignment with the shaft, it will not be impeded from rotating.

Claws with the aforesaid properties are also simple and inexpensive.

It is of particular advantage for the sides of the claw to be approximately at a distance apart that is twice the width of the transverse slot and to have prongs that bend toward one another. Such a dimension will allow the transverse bolt to rotate to a considerable extent in relation to the sides of the claw and even more reliably prevent the crank from separating unintendedly from the threaded shaft. The bending toward one another of the prongs is a simple means of ensuring that the threaded shaft will rotate far enough in relation to the claw.

Since the threaded shaft is thicker than the transverse slot is wide and the transverse bolt is thinner than the threaded shaft, the claw and hence the shaft of the crank cannot separate laterally and parallel with the transverse bolt from the threaded shaft.

To allow the shaft of the crank to rotate unimpeded in relation to the threaded shaft, the prongs on the sides of the claw demarcate recesses that are as long as the bent sections of the prongs and accommodate the threaded shaft. This characteristic also makes the prongs thinner and easier to bend.

The prongs on the sides of the claw bend toward each other farther from the rear wall of the claw than the transverse slot is wide. This characteristic allows the maximum possible divergence of the crank from its alignment with the threaded shaft without being impeded by the claw.

BRIEF DESCRIPTION OF THE DRAWINGS

One embodiment of the invention will now be specified with reference to the drawing, wherein.

DESCRIPTION OF THE PREFERRED EMBODIMENTS

Figure 1:
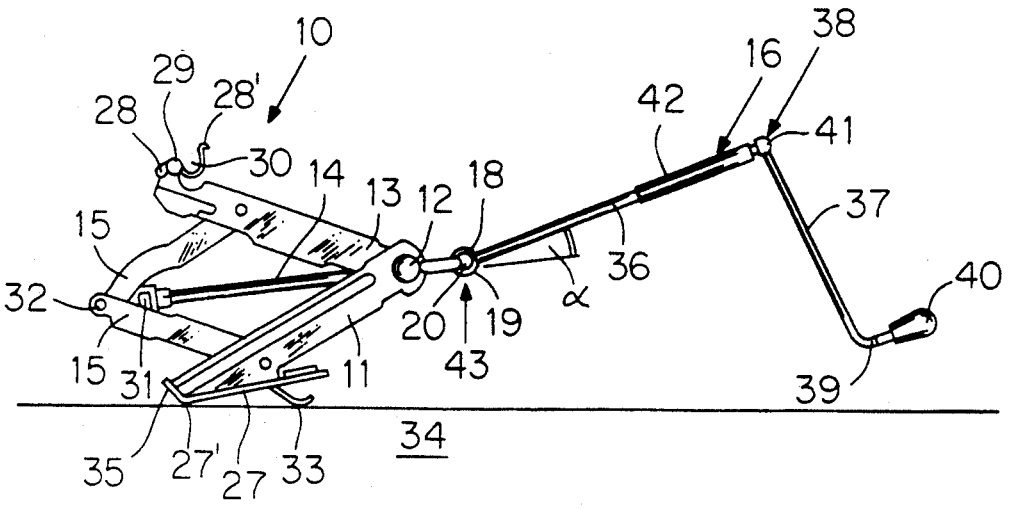
FIG. 1 is a side view of the jack and FIG. 2 is a perspective view of the end of the threaded shaft and of the adjacent end of the shaft of the crank.

It will be evident from FIG. 1 that jack 10 has a leg 11 with a rocker 27 rigidly secured to its bottom and a lifting arm 13 and threaded shaft 14 that pivot around a stationary horizontal axis 12 at its top. Pivoting on an axis 29 at the top of lifting arm 13 is a supporting plate 28 that is subject to an unillustrated spring that constantly forces it into a position with its free end 28' projecting up. Supporting plate 28 is positioned against the sill seam on the body of a motor vehicle such that the seam is accommodated by a recess 30 in supporting plate 28.

Jack 10 also has two lever arms 15 articulated to each other and to threaded shaft 14. They are articulated to the shaft by a bearing 31 that is in itself known and will accordingly not be specified herein, that is attached by way of an axis 32 of articulation that it shares with lever arms 15, and that has a roller bearing to eliminate friction in its support of threaded shaft 14.

The lever arm 15 that is articulated to leg 11 has an adjusting foot 33 rigidly secured to it. The foot extends through an unillustrated recess in rocker 27 and rests against a supporting surface 34, which is generally the ground that the vehicle is resting on. When threaded shaft 14 is activated with a manually operated crank 16, the parallelogram comprising lever arm 15, leg 11, and lifting arm 13 will elongate vertically in relation to supporting surface 34, and leg 11 and lifting arm 13 will lift the motor vehicle resting on supporting plate 28. Rocker 27 will simultaneously rock through its bend 27' and rise onto its base 35.

The crank 16 that is employed to rotate threaded shaft 14 has two shafts 36 and 37 articulated together at a point 38. User-adjacent shaft 37 has an angled end 39 with a rotating knob 40 and articulation end that engages the sides of a U-shaped connector 41 secured to jack-end shaft 36. The precise structure of point 38 of articulation is disclosed in German GM 8 701 736, attention to which is accordingly directed.

Positioned on shaft 36 in the vicinity of point 38 of articulation is a positioning sleeve 42 that shaft 36 can rotate in and that is axially maintained in an unillustrated way. When crank 16 is cranked, it is held at sleeve 42 with one hand while the other hand manipulates knob 40.

The end 14' of threaded shaft 14 is coupled to crank 16 at a universal-like articulation 43 that consists essentially of a transverse bolt 20 at the end of threaded shaft 14 and of an essentially U-shaped claw 18 at the end of crank 16. Transverse bolt 20 cannot rotate on threaded shaft 14 and claw 18 cannot rotate on the shaft 36 of crank 16.

As will be evident from a comparison of the diameter 21 of transverse bolt 20 with the diameter 23 of threaded shaft 14, transverse bolt 20 is thinner than threaded shaft 14.

U-shaped claw 18 has sides 19 that extend toward threaded shaft 14 from a rear wall 26. Rear wall 26 is perpendicular to shaft 36, and sides 19 project out parallel to the shaft. The sides end in short prongs 22 that bend toward one another and demarcate a transverse slot 17 with a width X. Width X is slightly greater than the diameter 21 of transverse bolt 20. Prongs 22 also demarcate recesses 25 that are approximately as deep as the length 24 of the bent section of prongs 22. Recesses 25 are wide enough to allow prongs 22 to come to rest against both sides of threaded shaft 14 when crank 16 is attached to the end 14' of threaded shaft 14 in the direction represented by arrow 46.

The distance Y between the sides 19 of claw 18 is approximately twice the width X of transverse slot 17. Prongs 22 bend at a distance Z from the rear wall 26 of claw 18. Distance Z is longer than the width X of transverse slot 17.

Figure 2:
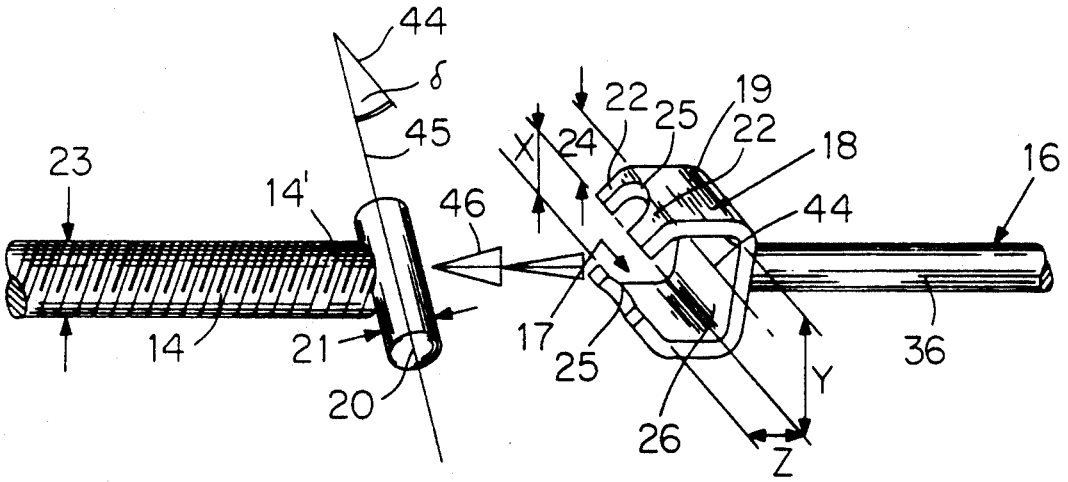

Crank 16 is attached to the end 14' of threaded shaft 14 by approaching claw 18 to transverse bolt 20 in the direction represented by arrow 46 until the bolt travels through transverse slot 17 and comes to rest between sides 19 (cf. FIGS. 1 and 2). The distance Y between sides 19 allows crank q6 to rotate in relation to threaded shaft 14. In this rotated position, the transverse axis 44 of claw 18 is at an angle $\alpha$ to the longitudinal axis 45 of transverse bolt 20 that characterizes a particular rotation. Each pair of diagonally opposite prongs 22 on sides 19 will accordingly engage the rear of transverse bolt 20 and prevent crank 16 from separating unintendedly from threaded shaft 14.

Lateral withdrawal of claw 18 parallel to the longitudinal axis 45 of transverse bolt 20 is impossible because each pair of vertically opposing prongs 22 are only distance X apart, whereby distance X is slightly longer than the diameter 21 of transverse web 20, so that prongs 22 will come into contact with threaded shaft 14 when crank 16 moves laterally.

As will be evident from FIG. 1, the shaft 36 of crank 16 can assume positions out of alignment with and at an angle $\alpha$ to threaded shaft 14. When crank 16 is in such a position, threaded shaft 14 will extend relatively horizontal with no risk of the knob 40 getting near enough to strike against supporting surface 34 while crank 16 is being cranked.

Articulation 43 must be designed to ensure effective cranking even when shaft 36 is out of alignment with threaded shaft 14 as illustrated in FIG. 1. When shaft 36 is position at angle $\alpha$ to threaded shaft 14, whatever sides 19 are at the top will engage the top of the transverse bolt to the extent that the associated recesses 25 or its prongs 22 will surround threaded shaft 14 to the maximum possible extent. Recesses 25 are accordingly deep enough and the distance Z of prongs 22 from rear wall 26 long enough for this purpose. The requisite play between claw 18 and transverse bolt 20 is accordingly sufficient to allow sides 19 to rotate in relation to transverse bolt 20 in the same direction as threaded shaft 14.

We claim:

1. A lifting jack comprising: a single leg with a stationary horizontal axis; a lifting arm pivoting about said stationary horizontal axis; a threaded shaft with a diameter connected pivotably to said leg and engaging said lifting arm, said threaded shaft having a longitudinal axis; a transverse bolt with a diameter and secured to an end of said threaded shaft, said transverse bolt having a longitudinal axis transverse to the longitudinal axis of said threaded shaft; a manually operated crank having a longitudinal axis; a fork-shaped claw formed from sheet metal and secured non-rotationally to an end of said crank, said claw comprising a flat end wall having a rectangular periphery, said end wall being mounted on one end of said crank, first and second flat side portions, each having one end attached to and extending substantially at a 90° angle from opposite peripheral edges of said end wall, and first and second flat lip portions extending toward each other at an angle less than 90° from the opposite end of said first and second side portions respectively: said first and second lip portions each including prongs spaced from each other by a distance corresponding substantially to the diameter of the shaft, said first and second lip portions each including a terminal free end, said terminal free ends being spaced from each other by a distance corresponding substantially to the diameter of the transverse bolt; whereby, when the said claw is engaged with said crank, said transverse bolt passes between said terminal free ends and is located in and closely surrounded by a slot bounded by said end wall, said first and second side portions, and said first and second lip portions; and whereby when said transverse bolt is located in said slot, said shaft is loosely surrounded by said prongs, such that said claw may impart force from said crank to said transverse bolt to rotate said shaft even when said crank and said shaft are not longitudinally aligned.

2. A lifting jack comprising: a single leg with a stationary horizontal axis; a lifting arm pivoting about said stationary horizontal axis; a threaded shaft with a diameter connected pivotably to said leg and engaging said lifting arm, said threaded shaft having a longitudinal axis; a transverse bolt with a diameter and secured to an end of said threaded shaft, said transverse bolt having a longitudinal axis transverse to the longitudinal axis of said threaded shaft; a manually operated crank having a longitudinal axis; a fork-shaped claw secured non-rotationally to an end of said crank, said claw having a transverse slot bounded by walls with sides for attaching said claw to said transverse bolt with sufficient looseness to turn said threaded shaft by said crank even when said shaft is not longitudinally aligned with said crank, said transverse slot having a longitudinal axis transverse to the longitudinal axis of said crank; said transverse slot in said claw being slidable over said transverse bolt with the longitudinal axis of said transverse slot sliding parallel to the longitudinal axis of said transverse bolt; said sides of said claw having prongs with ends spaced from each other by a distance corresponding substantially to the diameter of said bolt; said claw fitting loosely about said bolt for rotating freely around said bolt with the longitudinal axis of said transverse slot rotating freely relative to the longitudinal axis of said transverse bolt; said prongs surrounding loosely said shaft; said shaft being freely rotatable by said crank when the longitudinal axes of said shaft and said crank are not longitudinally aligned, wherein said walls with sides comprise a flat end wall, and first and second flat side portions each having one end attached to and extending from opposite peripheral edges of said end wall.

3. A lifting jack as defined in claim 2, including a connecting arm connecting said sides of said claw and separating said sides by a spacing equal substantially to twice said distance between said ends of said prongs, said prongs being bent toward one another.

4. A lifting jack as defined in claim 2, wherein said threaded shaft has a thickness exceeding said distance between said prongs, said transverse bolt being thinner than said threaded shaft.

5. A lifting jack as defined in claim 2, wherein said sides have recesses between said prongs, said recesses having a depth equal substantially to lengths of said prongs for fitting about said threaded shaft.

6. A lifting jack as defined in claim 2, wherein said claw has a rear wall, said transverse slot having a width, said prongs bending toward said other at a point located farther from said rear wall of said claw than said width of said transverse slot.

7. A lifting jack as defined in claim 2, wherein said claw has a substantially U-shaped cross-section.

8. A lifting jack comprising: a single leg with a stationary horizontal axis; a lifting arm pivoting about said stationary horizontal axis; a lever arm pivotably connected to said leg; a threaded shaft with a diameter connected pivotably to said leg and engaging said lifting arm through said lever arm, said threaded shaft having a longitudinal axis; a transverse bolt with a diameter and secured to an end of said threaded shaft, said transverse bolt having a longitudinal axis transverse to the longitudinal axis of said threaded shaft; a manually operated crank having a longitudinal axis; a fork-shaped claw secured non-rotationally to an end of said crank, said claw having a transverse slot bounded by walls with sides for attaching said claw to said transverse bolt with sufficient looseness to turn said threaded shaft by said crank even when said shaft is not longitudinally aligned with said crank, said transverse slot having a longitudinal axis transverse to the longitudinal axis of said crank; said transverse slot in said claw being slidable over said transverse bolt with the longitudinal axis of said transverse slot sliding parallel to the longitudinal axis of said transverse bolt; said sides of said claw having prongs with ends spaced from each other by a distance corresponding substantially to the diameter of said bolt; said claw fitting loosely about said bolt for rotating freely around said bolt with the longitudinal axis of said transverse slot rotating freely relative to the longitudinal axis of said transverse bolt; said prongs surrounding loosely said shaft; said shaft being freely rotatable by said crank when the longitudinal axes of said shaft and said crank are not longitudinally aligned, wherein said walls with sides comprise a flat end wall, and first and second flat side portions each having one end attached to and extending from opposite peripheral edges of said end wall.

* * * * *